US007828524B2

(12) United States Patent
Chen

(10) Patent No.: US 7,828,524 B2
(45) Date of Patent: Nov. 9, 2010

(54) NECKLACE STYLE PORTABLE COOLING DEVICE

(76) Inventor: Yung Chen, 1415 N. Dayton St., # 2 South, Chicago, IL (US) 60622

( * ) Notice: Subject to any disclaimer, the term of this patent is extended or adjusted under 35 U.S.C. 154(b) by 1014 days.

(21) Appl. No.: 11/588,943

(22) Filed: Oct. 30, 2006

(65) Prior Publication Data

US 2008/0101928 A1 May 1, 2008

(51) Int. Cl.
*F01D 25/28* (2006.01)

(52) U.S. Cl. ..... 416/63; 415/206; 415/213.1

(58) Field of Classification Search ..... 415/203, 415/206, 213.1, 214.1, 224; 416/63
See application file for complete search history.

(56) References Cited

U.S. PATENT DOCUMENTS 2,826,758 A * 3/1958 Kahn ..... 2/81
4,839,106 A 6/1989 Steiner
5,304,035 A 4/1994 Carter
5,338,495 A 8/1994 Steiner et al.
5,749,359 A * 5/1998 Hansen ..... 128/205.25
6,109,874 A * 8/2000 Steiner et al. ..... 416/63
6,155,782 A * 12/2000 Hsu ..... 416/63
6,192,702 B1 2/2001 Shimogori
6,511,289 B2 * 1/2003 Yu ..... 415/206
6,666,647 B1 * 12/2003 Trask ..... 415/211.2
6,955,524 B2 10/2005 Stengel
6,964,556 B2 * 11/2005 Chiu et al. ..... 415/205

* cited by examiner

*Primary Examiner*—Nathaniel Wiehe
(74) *Attorney, Agent, or Firm*—Basil E. Demeur; Alan B. Samlan; David J. Hurley

(57) ABSTRACT

A personal cooling device especially adapted to be worn around the neck of the user formed by an enclosure, a power source carried in the enclosure, a centrifugal flow impeller carried within the enclosure, a motor carried within the enclosure for powering the impeller and an air duct formed around the impeller. The enclosure is provided with an air inlet and an air discharge opening adaped to direct an air stream toward the user when hung around the user's neck.

14 Claims, 6 Drawing Sheets

NECKLACE STYLE PORTABLE COOLING DEVICE

I. FIELD OF THE INVENTION

The present invention is directed to improvements in a personal cooling device particularly adapted for being worn about the neck of the user and constructed in order to discharge an air stream upwardly toward the face of the user for cooling purposes. The improvement generally relates to providing the device with a centrifugal flow impeller, and a volute shaped duct surrounding the centrifugal impeller improving the volume of air directed into the air stream as well as more precisely directing the air stream toward the user.

II. BACKGROUND OF THE INVENTION

The present invention is basically directed to improvements with respect to personal cooling devices, especially the type of device that is intended to be worn by the user and directing an air stream toward the user for cooling purposes. Personal cooling devices have become quite popular, especially in hot climates, since it affords the user thereof to be able to carry a cooling device with them to any particular venue, and to activate the device in order to cool the body. Many of such devices, indeed, most of such devices, consist of hand held portable fans, which are battery operated and intended to be held by the user's hand, in order to direct air flow toward the user. As is well known, such personal fans generally will have foam blades so that the user is protected against injury, the foam blades being made of a very soft material such that injury is avoided should the user make contact with the fan blades. Other variations of such devices include personal cooling fans which have a water reservoir attached thereto, and some type of pump arrangement that the user is able to pump water up to a discharge nozzle, which usually is in line with and/or transverse to the air flow created by the fan, such that the user can achieve cooling not only by an air stream, but also with a mist of cool water which is blown toward the user. Such types of fans as described herein are exemplified by U.S. Pat. No. 4,839,106 which shows a portable misting fan which is a self contained unit and includes a fluid reservoir. Improvements to these devices are shown in U.S. Pat. No. 5,338,495 which disclose an integral portable fan with an atomizing head unit adapted for attachment to a fluid reservoir so that the user may manipulate a pump to create a mist directed into the air stream created by the fan. Various other patents illustrate similar types of devices.

The present invention is particularly adapted to a personal cooling fan device which is adapted for being worn about the neck of a user and constructed so that the air created by the fan is directed upwardly toward the head and neck portion of the user. Prior art type devices may include the patent to Carter U.S. Pat. No. 5,304,035 which teaches a basic necklace fan with a cage around the fan blades and a battery enclosure hanging below for balance purposes. Such devices however, tend to be rather bulky, and pose difficulties for the user thereof. Another typical prior art type device consists of a fan carried on an enclosure which has a plurality of batteries therein and a switch for operating a motor which drives the fan. The fan includes a semi-circular guard to which the fan is attached, and the guard being constructed to lie against the chest of the user and direct the fan's air stream in an upwardly direction in order to achieve the cooling effect. The fan blade is made of a soft foam material in order to avoid any injury to the user. A strap is provided which attaches to the guard in order to achieve the ability to hang the device around the neck of the user.

The patent to Trask U.S. Pat. No. 6,666,647 attempts to address the problem of the bulkiness of the device by turning the fan sideways and using a duct downstream of the fan blades to direct the air upward toward the users face. The patent to Stengel U.S. Pat. No. 6,955,524 attempts a further improvement by weighting the battery enclosure and making it flat so that it lies against the user's chest. The fan blades are soft and therefore may be left unguarded and while still avoiding any injury to the user. The patent to Hanson U.S. Pat. No. 5,749,359, attempts a further improvement by adding an air filter to the device to further clean the air before it is discharged toward the user.

The patent to Shimogari U.S. Pat. No. 6,192,702, adds a belt clip and a chiller block of a freezable material that chills the air blowing past it. The chiller block is placed downstream of the fan in order to pick up chilled air in order to direct it to the user.

It will therefore be appreciated from the above, that the prior art has made various attempts at providing a necklace style personal cooling device to be worn around the neck of the user in order to achieve a cooling effect. However, the problem associated with the devices provided in the prior art is that they are bulky in view of the fact that the breadth of the axial flow fan is perpendicular to the users body. Further, the bulkiness of the unit often obstructs the ability of the user to engage in activities since the device is hanging in front of the user. Hence, tasks such as operating a computer, or sitting at a desk is often impeded by the bulkiness of the device.

The object of the present invention is therefore to provide an improvement to a necklace style portable cooling device by eliminating the bulkiness thereof, and further improving the air flow which is discharged from the device such that one achieves a greater efficiency in use of the unit.

III. OBJECTS AND ADVANTAGES

It is therefore the principal object of the present invention to provide an improved portable personal cooling device of the type particularly adapted for being worn around the neck of the user which has a slim line configuration, with an improved air flow.

In furtherance of the above object, a further object of the present invention to provide a personal cooling device adapted for being worn around the neck of the user, which is constructed by means of an enclosure having a length which is somewhat elongate, and a width which is very slim. The enclosure contains a centrifugal flow impeller which is driven by a motor, the enclosure further having a compartment to contain a plurality of batteries for driving the motor. The enclosure includes an air inlet preferably located in the front portion of the enclosure, and a discharge opening at an upper adjacent surface which directs the air flow upwardly.

In conjunction with the foregoing object, it is a further object of the present invention to provide a personal cooling device of the type described, which is further provided with a discharge duct that surrounds the centrifugal flow impeller and has a cross-section that increases linearly from the point of the beginning of the duct, to the discharge end of the duct. Hence, the outer wall of the duct takes a volute configuration.

A further object of the present invention is to provide a personal cooling device of the type described, which accommodates a strap to be attached to the device so that the device may be worn around the neck of the user, and also further includes a stand pivotally mounted to the rear wall of the enclosure, the stand allowing for the adjustment of the device against the body of the user and the user to adjust the direction of the air flow, and also provides a stand for placing the device on an underlying flat surface so that the device may be a desk top type fan device.

Further objects and advantages of the invention will be better understood by reference to the accompanying drawings taken in conjunction with the following specifications.

IV. BRIEF DESCRIPTION OF THE DRAWINGS

VI. DETAILED DESCRIPTION OF DRAWINGS

Figure 1:
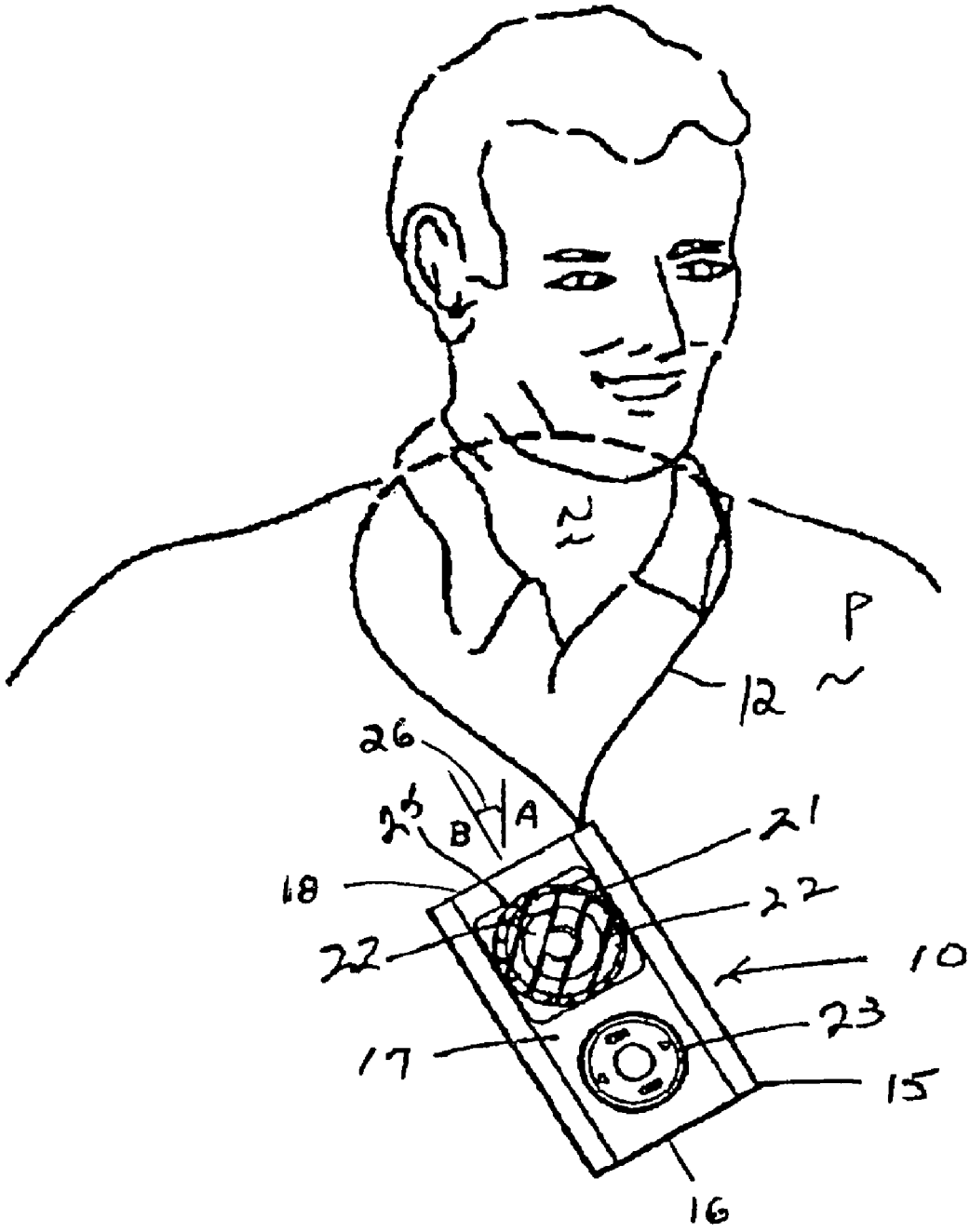
FIG. 1 is a front view illustrating a personal cooling fan device as worn around the neck of a user.

In FIG. 1 of the drawings, the necklace fan device 10 of the present invention is illustrated as being worn about the neck N of the user P. The necklace fan device 10 includes a strap 12 which allows the device to be hung about neck N of the user P. As shown in FIG. 1, the necklace fan device 10 is formed by an enclosure 15 which includes a front half portion 17 which connects to a rear half portion 19 (FIG. 3) by means of any appropriate fastening means such as screws of the like. The front half portion 17 includes an air inlet 21 which is shown to have a plurality of vanes 22 extending across the air inlet 21. The impeller 25 is shown to be contained in the enclosure 15 protected by means of the vanes 22 lying across the air inlet 21. A switch 23 is provided which, as is customary, would have an on position, and an off position for actuating the fan device and for turning it off. With specific reference to FIGS. 2 through 4A of the drawings, the necklace fan device 10 is shown in greater detail. It will be observed in FIG. 2, that the enclosure 15 is provided with an air discharge opening 30, positioned at the top end of the enclosure 15. The discharge opening is provided with a series of ribs 32 mounted there across which function to protect access to the interior of the enclosure 15 by the user P, and constructed in a manner to further enhance and facilitate the direction of the air stream created by the impeller 25.

Figure 2:
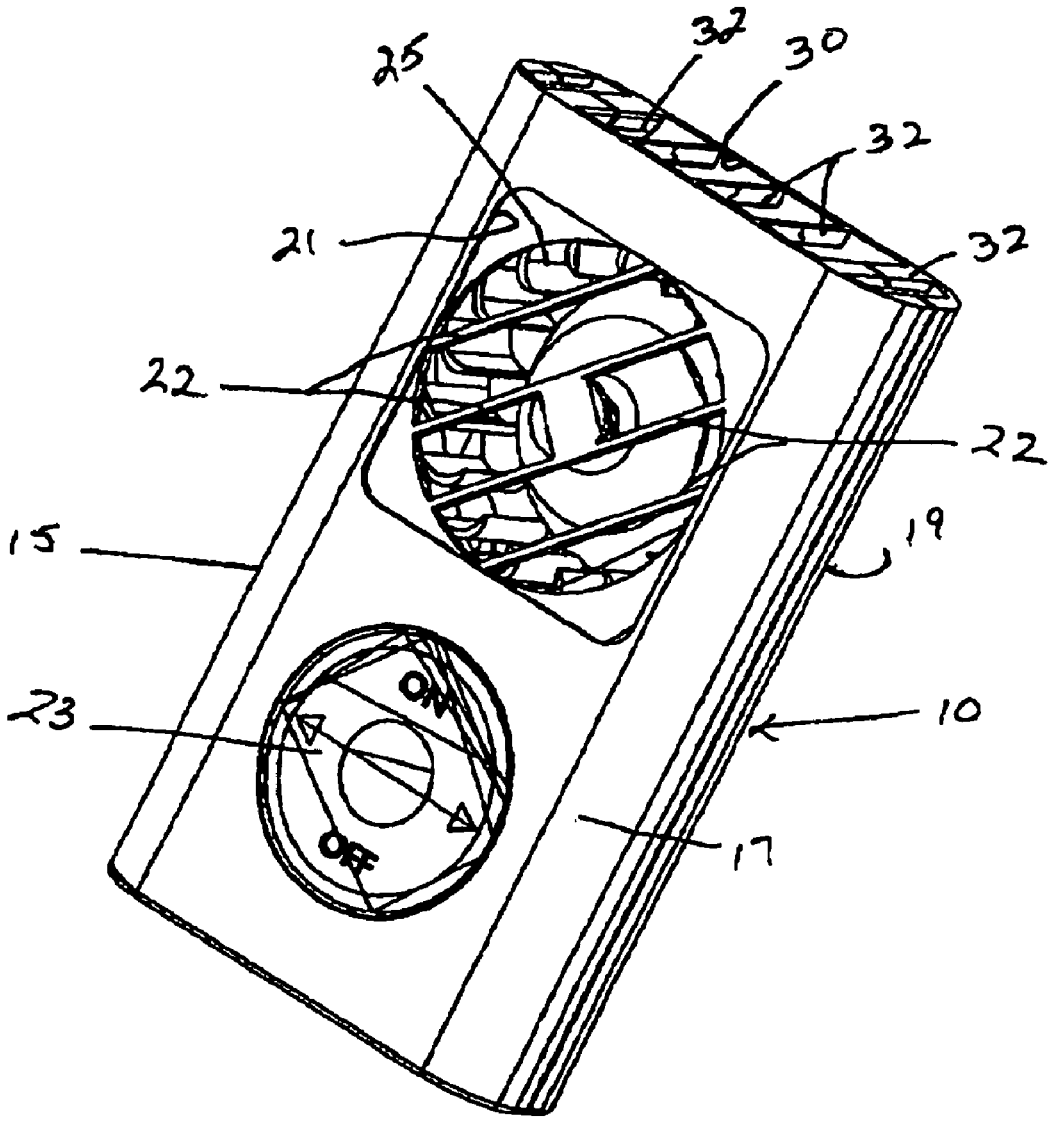
FIG. 2 is a front elevational perspective view showing the personal cooling fan device of the present invention.
Figure 3:
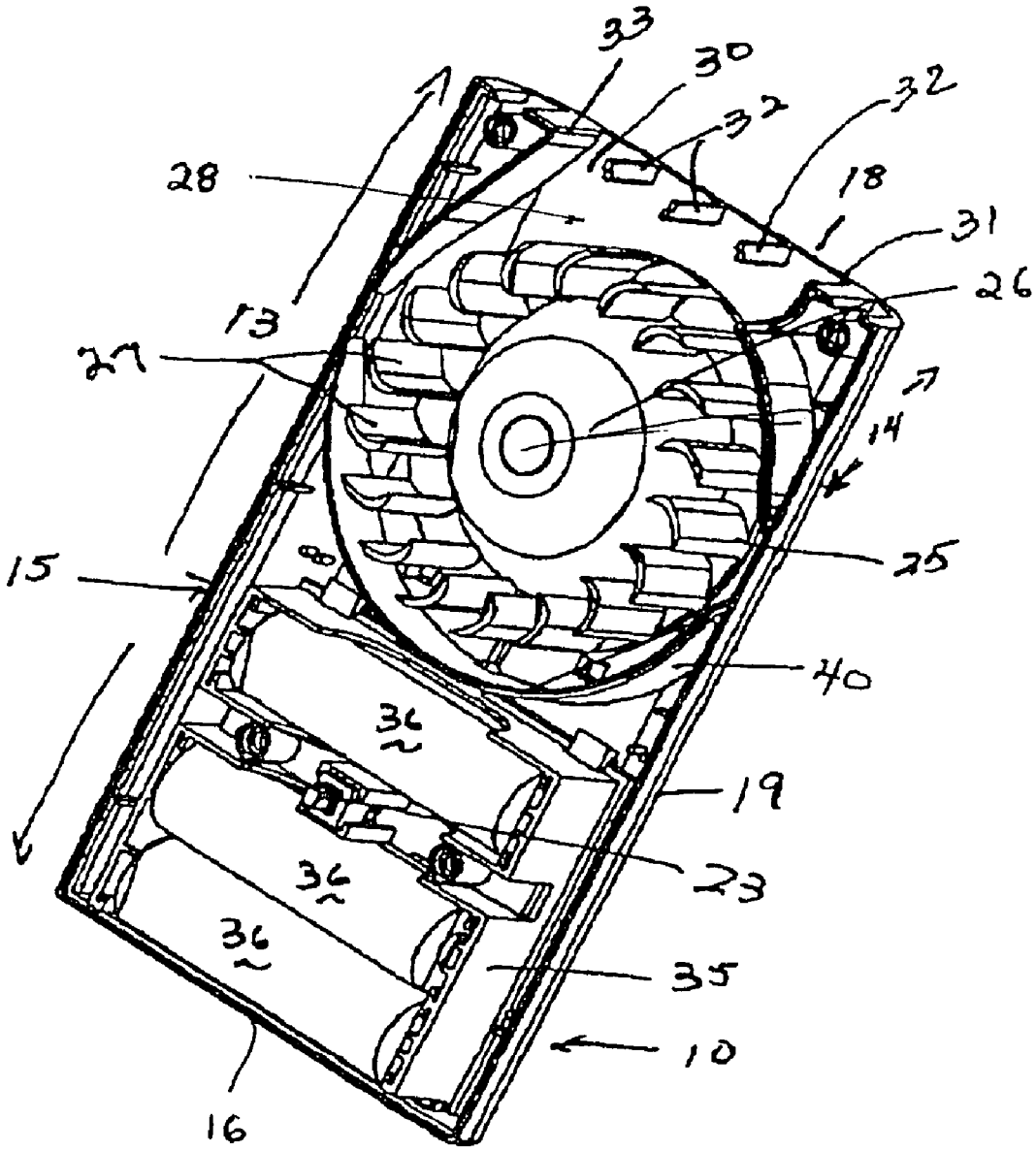
FIG. 3 is a front elevational view of the cooling fan device of the present invention with the front wall removed illustrating the interior of the device.
Figure 3A:
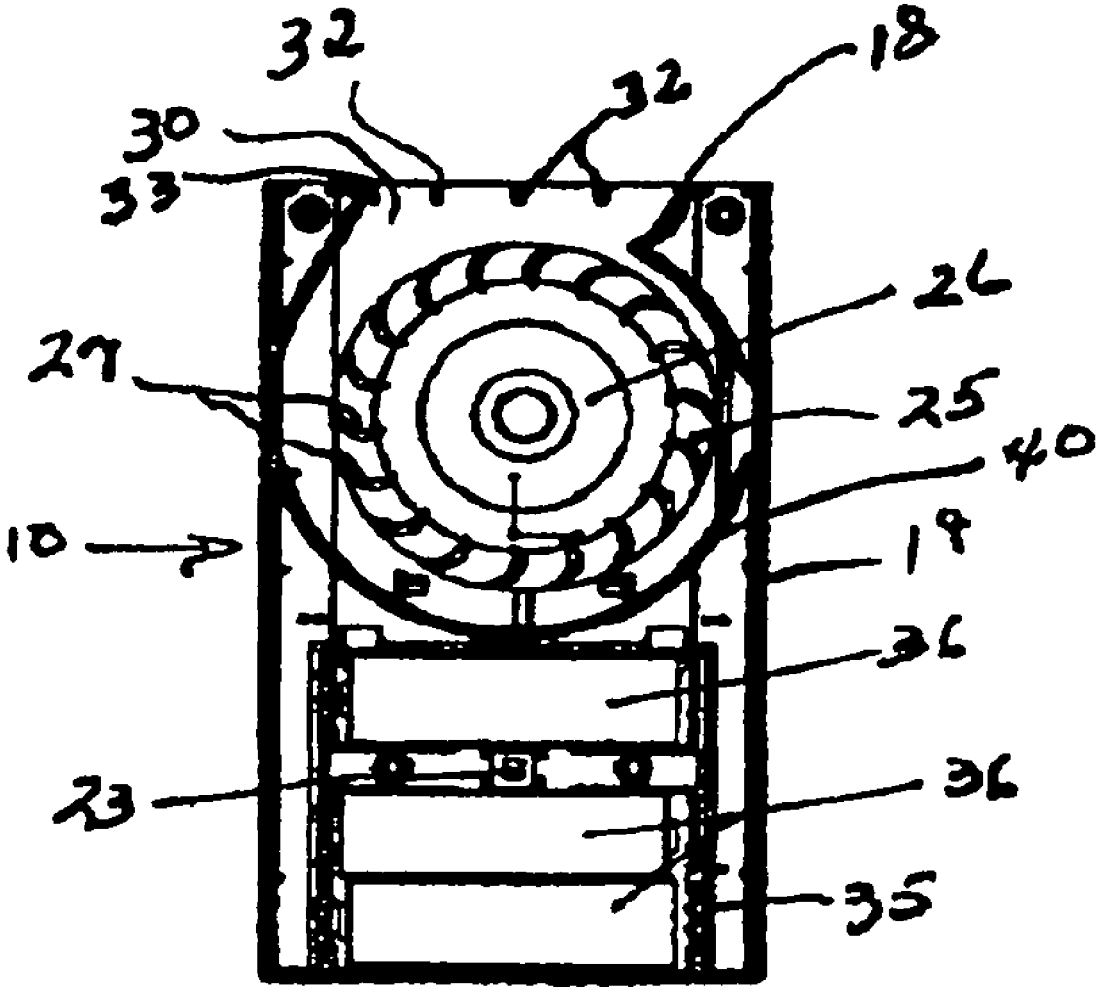
FIG. 3A is a side elevational view of the device as shown in FIG. 3, with the front wall removed and showing the arrangement of the centrifugal flow impeller, relative to the volute duct.

As shown in the FIGS. 2 through 3A, the enclosure 15 assumes a substantially rectangular configuration having an elongate length 13, and thin width 14 as indicated previously, and the top 18 of the enclosure 15 is provided with the discharge opening 30. It will be appreciated from the description and the figures as indicated, that the necklace fan device 10 of the present invention assumes a very thin configuration thereby eliminating any bulkiness when being worn by the user P. With particular reference to FIGS. 3 and 3A of the drawings, the arrangement of the various parts are more clearly illustrated. The enclosure 15 is shown to include a battery compartment 35 which contains a plurality of batteries 36 thereby providing a power source for the device. The switch 23 is located so as to be in electrical contact with the batteries 36 in order to provide power for the impeller 25.

The impeller 25 is provided with a hub 26 which attaches to a motor shaft and in turn a motor (not shown), in a manner well known in the art. The motor is an electrical contact with the power source via the switch 23, such that upon activation of the switch 23, the motor is activated thereby to turn the impeller 25. In the preferred embodiment of the present invention as shown in FIG. 3 of the drawings, the impeller 25 with its hub 26, motor and motor shaft are mounted to be secured within the rear half portion 19 of the enclosure 15. It will be clear from a view of FIG. 2 of the drawings, that the front half portion 17 mounts to the rear half portion 19 and is fastened thereto by an appropriate means such as screws, snap fit locking devices or the like. It will also be observed in FIG. 3, that the device includes a duct 40 which surrounds the circumference of the impeller 25 in spaced relation and whose radial cross-section increases with the angular measure from the beginning point of the duct 40 to the discharge opening 30. In the preferred embodiment: the duct 40 commences at a rearward end 31 of the discharge opening 30 and terminates at a forward end 33 of the discharge opening 30. The duct 40 further creates a cavity 28 between the rearward end 31 and the forward end 33 which surrounds the circumference of the impeller 25 adjacent to the discharge opening 30. As such, the duct 40 has a spiral or volute shape. As shown in FIG. 3, the impeller 25 is constructed to rotate in a clockwise direction, and it will be further observed that the impeller 25 is constructed by means of a plurality of arc shaped blades 27, and when rotating in a clockwise direction, captures air from the air inlet 21, and moves the air around the duct 40 and expels the air stream through the discharge opening 30. The ribs 32 assume a configuration which aides and facilitates in the direction of the air stream emanating from the discharge opening 30. It will be appreciated that the duct 40, being substantially volute in shape, in combination with the centrifugal flow impeller 25 having arc shaped blades 27 creates an improved air flow such that the air stream discharged from the discharge opening 30 is greatly improved over prior art devices. In this manner, the duct 40 and the plurality of arc shaped blades 27 of the impeller 25 redirect the air perpendicularly from the air inlet 21 into the cavity 28 in direction of a resting plane B with the duct 40 further redirecting the air into a vertical plane A for discharge of the air through the discharge opening 30 to effectively cool the user. This is achieved despite the fact that the width dimension 14 which is parallel to the motor shaft (not shown) is very thin to give the device 10 a very compact configuration thereby eliminating any bulkiness relative to the device when worn by the user P.

It will also be observed from a view of FIG. 1 of the drawings once again, that the strap 12 is connected to the device 10 at one corner of the enclosure 15 which causes the device 10 to hang at an angle. In this manner, the top 18 and the bottom 16 of the cooling device are aligned in the resting plane B which is situated at an acute angle 26 to the vertical plane A of the user. From a view of FIG. 3 of the drawings, it will be appreciated that due to the configuration of the duct 40, as well as the ribs 32, air is discharged through the discharge opening 30 at an angle from the center axis of the enclosure 15. Hence, the air stream which impacts the user P will come directly upwardly to cool the neck and face of the user P. Hence by providing the duct 40 in a substantially volute configuration, the air flow is accordingly adjusted to be angularly discharged so that even though the device 10 is hung at an angle around the user's neck, the air flow will be directly upwardly.

Figure 4:
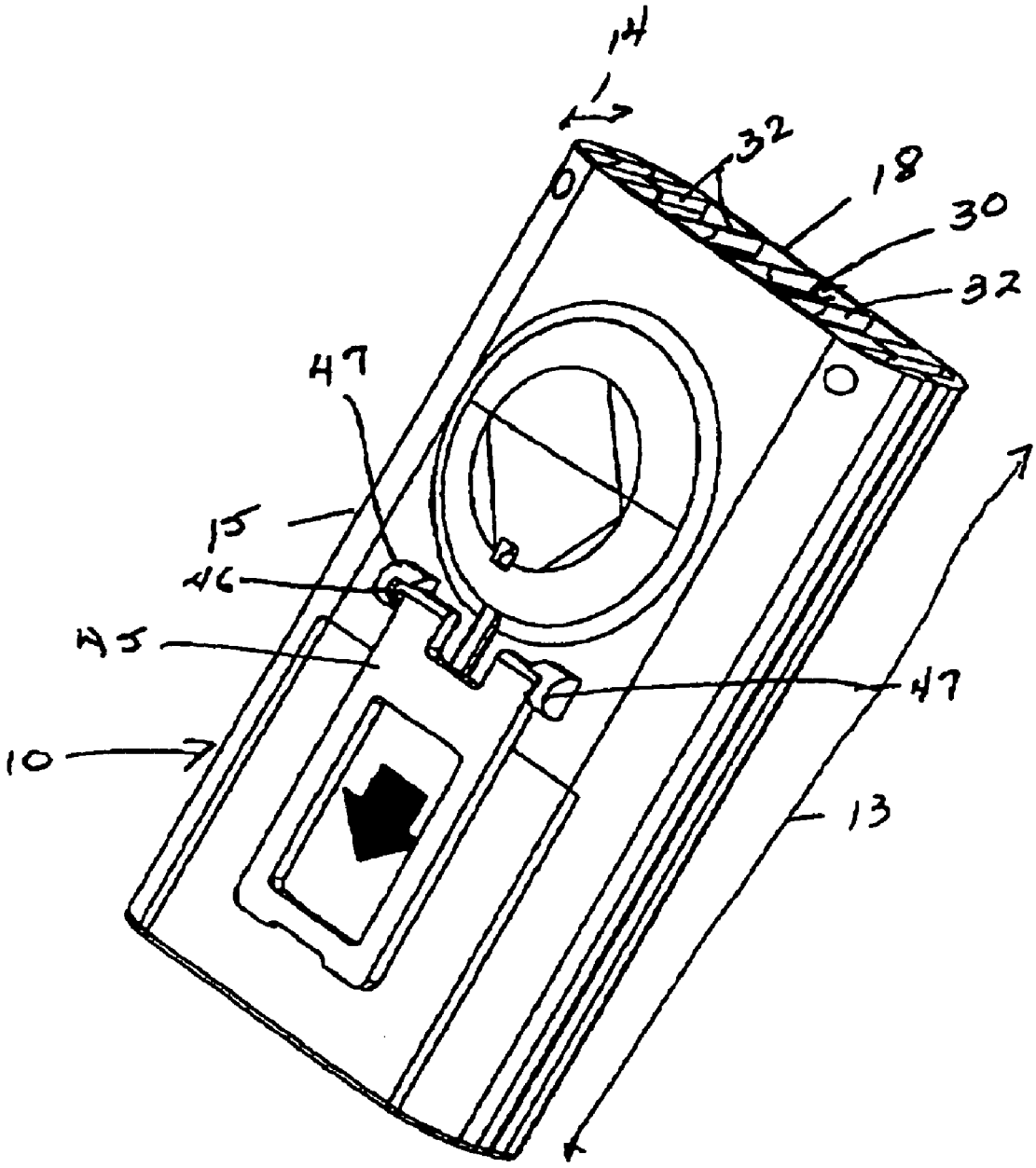
FIG. 4 is a elevational view in perspective illustrating the rear wall of the device and showing the pivotal stand associated therewith.
Figure 5:
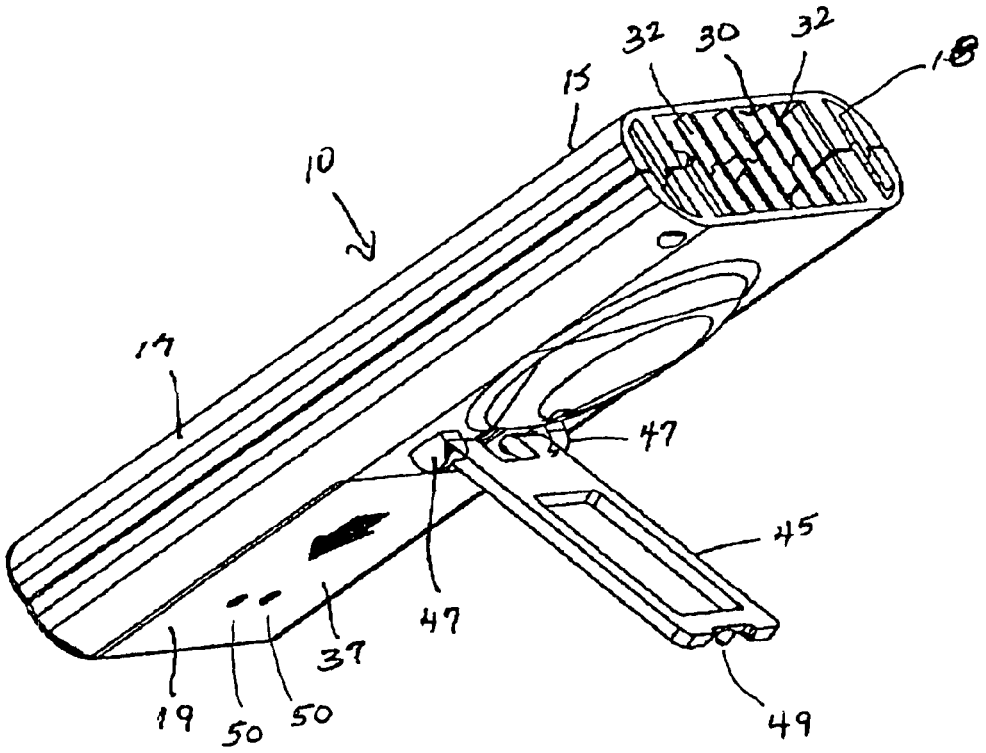
FIG. 5 is a side elevational view in perspective illustrating the pivotal stand in the open position.

FIG. 4 illustrates that the device 10 may optionally be provided with a stand 45 which is pivotally secured to the rear half portion 19 by means of a pair of opposed pins 46 which are held in place by means of opposed pivot enclosures 47. As shown in FIG. 5, the stand may be pivotally moved to its open position in order to allow the device 10 to be positioned on a flat underlying support surface, and can be positioned at an angle such that the air stream emanating from the discharge opening 30 will blow onto the user when seated at a desk or the like. Hence, the device 10 can be used just as equally as a desk top unit or a table top unit as well as worn around the neck N around the user P. FIGS. 4 and 5 further illustrate that the battery compartment 35 is covered by means of a battery door 37 in a manner well known in the art such that the battery door 37 may be removed in order to replace batteries in the device 10.

The switch 23 (FIG. 2) assumes various configurations. As shown in FIG. 2, the switch 23 may be covered by a decorative escutcheon that doubles as a switch actuating membrane. The user P pushes on the escutcheon and as it flexes, the back surface of the escutcheon engages a push button switch located behind it (FIG. 3). Again, such types of switches are well known in the art.

A further improvement, and as demonstrated in FIG. 5, shows that the stand 45 may have a pair of lock pins 49 which will engage apertures 50 located in the battery door of 37. The lock pins 49 will engage the apertures 50 when the stand 45 is pivoted to its closed position and serve the dual purpose of preventing the stand 45 from movement when it is in its closed position, and further prevents the battery door 37 from sliding open when the stand 45 is again, in the closed position.

It will be appreciated from the above description that the present invention provides an improved necklace style fan device which can be especially adapted for wearing about the neck of a user. The device is constructed to have a slim configuration thereby eliminating bulkiness, while nevertheless improving upon the air flow derived from the device by employing a centrifugal impeller, and having a volute shaped duct internally in the device surrounding the impeller thereby to improve the air flow derived from the device. Hence, the present invention improves upon the necklace style hand devices by eliminating the bulkiness associates with such devices while at the same time improving upon the air flow derived from the device.

While there has been described what is at present to be considered to be the preferred embodiment of the invention, it will be understood that various modifications may be made therein without departing from the true spirit and scope of the invention as defined in the appended claims.

The invention claimed is:

1. A cooling device adapted to be worn on the body of the user comprising, an enclosure having a plurality of continuous surfaces and including a front half portion, a rear half portion, and further defining a top and a bottom, a power source contained within said enclosure, fan means carried within said enclosure for creating an air stream, a motor interconnected with said fan means and by a motor shaft and connected to said power source for operating said fan means, actuation means for actuating said motor, an air inlet formed in said enclosure, an air discharge opening formed in said top of said enclosure and associated with said fan means for discharging the air stream created by said fan means, a duct associated with said air discharge opening, said duct commencing at a rearward end of the air discharge opening; and terminating at a forward end of said air discharge opening, said duct further creating a cavity between said rearward end and said forward end adjacent to said air discharge opening, said fan means comprising a centrifugal flow impeller having a plurality of blades, said duct surrounding a first portion of the circumference of said centrifugal flow impeller and said plurality of blades, said cavity surrounding a second portion of the circumference of said centrifugal flow impeller and said plurality of blades, means for securing said cooling device onto the body of the user and positioning said cooling device in relation to the body of the user, said user defining a vertical plane, said top and bottom of said cooling device aligned in a resting plane and situated at an acute angle to the vertical plane of the user, and whereby said cooling device is constructed to receive air from the air inlet, said duct and said plurality of blades of said centrifugal flow impeller redirecting said air perpendicularly from said air inlet into said cavity in the direction of the resting plane, said duct further redirecting said air from the resting plane into the vertical plane for discharge of the air through the discharge opening to effectively cool the user.

2. The cooling device as set forth in claim 1 above, wherein said duct associated with said discharge opening is substantially radial in cross section from the rearward end of said discharge opening to the forward end of said discharge opening.

3. The cooling device as set forth in claim 2 above, wherein said duct is substantially volute in shape.

4. The cooling device as set forth in claim 1 above, wherein said duct is constructed in order to direct the air stream created by said fan means through said discharge opening in a path substantially normal to the motor shaft.

5. The cooling device as set forth in claim 1 above, wherein said means for securing said cooling device onto the body of the user comprises a strap adapted to hang said cooling device about the neck of the user thereby to render said device wearable.

6. The cooling device as set forth in claim 5 above, wherein said duct and associated discharge opening is configured to discharge the air stream created by said fan means in an upward direction when said cooling device is hung about the neck of the user.

7. The cooling device as set forth in claim 1 above, wherein said air inlet is formed in said front half portion of said enclosure.

8. The cooling device as set forth in claim 1 above, wherein said air inlet formed in said enclosure is positioned on a surface adjacent to said front half portion.

9. The cooling device as set forth in claim 1 above, wherein said duct is formed by a first duct portion formed integrally with said front half portion and a second duct portion formed integrally with said rear half portion, whereby the interconnection of said front and rear half portions creates said duct.

10. The cooling device as set forth in claim 1 above, wherein said enclosure assumes a box shape configuration which is elongate in length and thin in width.

11. The cooling device as set forth in claim 1 above, wherein said air inlet includes a series of ribs to protect the fan means from user access.

12. The cooling device as set forth in claim 5 above, wherein said discharge opening includes a plurality of ribs extending across said opening.

13. The cooling device as set forth in claim 12 above, wherein said ribs are positioned in a manner to facilitate the direction of the air stream created by said fan means in an upward direction when worn about the neck of the user.

14. The cooling device as set forth in claim 1 above, wherein said enclosure is provided with a stand pivotally mounted to said rear half portion thereof, said stand being pivotally movable to allow said device to be adjusted to discharge the air stream toward the user and further allow for placement on an underlying flat support surface.

* * * * *